US011319740B2

(12) United States Patent
Byun

(10) Patent No.: US 11,319,740 B2
(45) Date of Patent: May 3, 2022

(54) MULTI-LINK HINGE DEVICE

(71) Applicant: EPTECH CO., LTD., Gyeonggi-do (KR)

(72) Inventor: Chun Ho Byun, Gyeonggi-do (KR)

(73) Assignee: EPTECH CO., LTD., Gyeonggi-do (KR)

( * ) Notice: Subject to any disclaimer, the term of this patent is extended or adjusted under 35 U.S.C. 154(b) by 0 days.

(21) Appl. No.: 15/733,969

(22) PCT Filed: Feb. 18, 2019

(86) PCT No.: PCT/KR2019/001899
§ 371 (c)(1),
(2) Date: Dec. 1, 2020

(87) PCT Pub. No.: WO2020/105805
PCT Pub. Date: May 28, 2020

(65) Prior Publication Data

US 2021/0238902 A1 Aug. 5, 2021

(30) Foreign Application Priority Data

Nov. 20, 2018 (KR) ..... 10-2018-0143101

(51) Int. Cl.
*E05F 3/20* (2006.01)
*E05D 3/16* (2006.01)
*E05D 11/10* (2006.01)

(52) U.S. Cl.
CPC ..... *E05F 3/20* (2013.01); *E05D 3/16* (2013.01); *E05D 11/1007* (2013.01);
(Continued)

(58) Field of Classification Search
CPC .. E05F 3/20; E05F 1/1253; E05D 3/15; E05D 11/1007; E05Y 2201/21; E05Y 2201/22; E05Y 2800/41; E05Y 2900/20
See application file for complete search history.

(56) References Cited

U.S. PATENT DOCUMENTS 7,886,407 B2 * 2/2011 Resnik ..... E05F 3/108 16/286
7,987,558 B2 8/2011 Beckmann et al.
(Continued)

FOREIGN PATENT DOCUMENTS

KR 10-2007-0101298 A 10/2007
KR 10-2010-0016056 A 2/2010
KR 10-1438049 B1 9/2014
KR 10-2015-0111949 A 10/2015
KR 10-2018-0108729 A 10/2018

OTHER PUBLICATIONS

International Search Report dated Aug. 6, 2019 issued in corresponding PCT/KR2019/001899 application (3 pages).

*Primary Examiner* — Victor D Batson
*Assistant Examiner* — Matthew J Sullivan
(74) *Attorney, Agent, or Firm* — Millen, White, Zelano & Branigan, P.C.; William Nixon

(57) ABSTRACT

The present invention discloses a multi-link hinge device, wherein the multi-link hinge device includes a bottom lever installed on a main body of a member with a door and having a first bottom fastening hole and a second bottom fastening hole formed to be spaced apart from an end side; a top lever installed on the door of the main body and having a first top fastening hole and a second top fastening hole spaced apart from each other; a body lever having one end pivotally connected to the first bottom fastening hole and having a first body fastening hole formed at the other end and a second body fastening hole formed inside; a first link pivotally connected to the first top fastening hole and the first body fastening hole; a second link pivotally connected to the second top fastening hole and the second body fastening hole, and having a link central fastening hole formed inside; a third link pivotally connected to the link central fastening hole and the second bottom fastening hole; and a rocker arm that is pivotally connected to the first link and guides the door to move to a closing position selectively by elasticity
(Continued)

when the top lever for opening and closing the door is operated; wherein the top lever includes a latching member that is rotatably provided so as to be selectively latch-positioned on an elastic action section formed on the rocker arm, and receives an elastic force from an elastic member provided on the rocker arm to guide the door to elastically move along the elastic action section.

6 Claims, 8 Drawing Sheets

(52) U.S. Cl.
CPC ..... *E05Y 2201/21* (2013.01); *E05Y 2201/22* (2013.01); *E05Y 2800/41* (2013.01); *E05Y 2900/20* (2013.01); *E05Y 2900/30* (2013.01); *E05Y 2900/31* (2013.01)

(56) References Cited

U.S. PATENT DOCUMENTS

| | | | | |
|---|---|---|---|---|
| 8,225,459 | B2 | 7/2012 | Waltemate et al. | |
| 8,296,906 | B2 * | 10/2012 | Wisniewski | E05D 3/14 16/370 |
| 9,739,081 | B2 * | 8/2017 | Stuke | E05F 5/006 |
| 10,221,597 | B2 * | 3/2019 | Hammerer | E05F 5/006 |
| 2008/0276422 | A1 | 11/2008 | Beckmann et al. | |
| 2010/0101052 | A1 | 4/2010 | Waltemate et al. | |
| 2015/0096147 | A1 * | 4/2015 | Rohner | E05D 3/12 16/233 |
| 2015/0361709 | A1 | 12/2015 | Stuke | |
| 2019/0368247 | A1 * | 12/2019 | Carbone | E05D 3/14 |
| 2020/0340279 | A1 * | 10/2020 | Kikuchi | E05D 3/16 |
| 2020/0370349 | A1 * | 11/2020 | Zetti | E05F 5/02 |

* cited by examiner

MULTI-LINK HINGE DEVICE

TECHNICAL FIELD

The present invention relates to a multi-link hinge device, and more particularly, to a multi-link hinge device capable of easily opening and closing the door of the members such as home appliances and furniture in a narrow space.

BACKGROUND

In general, the members such as home appliances and furniture with a door consist of a main body and the door hingedly connected to the main body to open and close the main body, such that the main body is opened and closed by rotating the door.

Here, when a refrigerator among the plurality of members is described as an example, the related prior art is disclosed in Utility Model Laid-Open Publication No. 20-1999-0035936, entitled "HINGE OF DOOR FOR REFRIGERATOR".

However, as the refrigerator becomes larger, the size of the door also increases. Accordingly, the range of rotation of the door relative to the main body is increased. As a result, there was a problem that the space for installing the refrigerator was limited. In order to reduce the space required for opening and closing the door, the need for a hinge that can reduce the door rotation space is increasing when the door is rotated in the main body.

SUMMARY

An object of the present invention is to provide a multi-link hinge device which includes a rocker arm in which an elastic action section is provided and a latching member is latched on or latch-released from a locker arm when the door is moved along the closing position, such that the door can be selectively and elastically moved. Thereby, an elastic movement of the door contrary to the user's intention may be blocked, and accordingly, there is an effect of preventing the user's injury in advance.

According to the present invention, a multi-link hinge device may be provided and the multi-link hinge device may include a bottom lever installed on a main body of a member with a door and having a first bottom fastening hole and a second bottom fastening hole formed to be spaced apart from an end side, a top lever installed on the door of the main body and having a first top fastening hole and a second top fastening hole spaced apart from each other, a body lever having one end pivotally connected to the first bottom fastening hole and having a first body fastening hole formed at the other end and a second body fastening hole formed inside, a first link pivotally connected to the first top fastening hole and the first body fastening hole, a second link pivotally connected to the second top fastening hole and the second body fastening hole, and having a link central fastening hole formed inside, a third link pivotally connected to the link central fastening hole and the second bottom fastening hole, and a rocker arm that is pivotally connected to the first link and guides the door to move to a closing position selectively by elasticity when the top lever for opening and closing the door is operated, wherein the top lever includes a latching member that is rotatably provided so as to be selectively latch-positioned on an elastic action section formed on the rocker arm, and receives an elastic force from an elastic member provided on the rocker arm to guide the door to elastically move along the elastic action section.

The top lever further may include a locking member in which the door may be moved continuously and elastically by supporting the latching member when it is latched into the latching groove provided in the latching member, and the elastic movement of the door may be released when it is latch-released into the latching groove.

Here, the latching member may include a latching piece formed to protrude inside the latching groove so that a position of the locking member is fixed inside the latching groove.

Further, the latching member may have a constant velocity section and an acceleration section to sequentially move toward the closing position at constant velocity and acceleration when the top lever is operated.

In addition, the rocker arm may include a main body coupled to the first link and having a receiving area therein, and an elevating member coupled to the upper portion of the main body by the elastic member provided in the receiving area to be able to move up and down and to form the elastic action section.

Meanwhile, the multi-link hinge device according to the present invention further may include a damper unit hingedly coupled to the bottom lever and the body lever and configured to apply a damping force to the body lever when the top lever is operated Here, the damper unit may include a cylinder tube rotatably that is connected to the bottom lever and accommodated so that a piston applying the damping force toward the body lever may be slidable by a fluid, and a piston rod that has a length and is connected to the piston and extends to the outside of the cylinder tube and rotatably connected to the body lever.

In addition, the third link may include a concave portion formed to have a shape corresponding to a lower shape of a coupling member of the top lever that guides coupling of the second link when the door is moved to the closing position.

According to the present invention, the multi-link hinge device may be provided with a rocker arm on which an elastic action section is provided, and a latching member is latched on or latch-released from the locker arm when the door is moved along the closing position, such that the door can be selectively and elastically moved. Thereby, the elastic movement of the door contrary to the user's intention may be blocked and accordingly there is an effect of preventing the user's injury in advance.

In addition, according to the present invention, the multi-link hinge device may be provided with a concave portion formed concave with a predetermined slope on the third link disposed to overlap with the top lever when the door is moved to the closing position. Thereby, the interference between the top lever and the third link can be prevented in advance, and accordingly, there is an effect of preventing wear and damage caused by collisions between members during repeated movements of the door.

DETAILED DESCRIPTION

Hereinafter, the preferred embodiments of the present invention will be described in detail with reference to the accompanying drawings.

Advantages and features of the present invention and a method of achieving the same will become apparent with reference to the embodiments described below in detail together with the accompanying drawings.

However, the present invention is not limited by the embodiments disclosed below, but will be implemented in a variety of different forms. The present embodiments are provided only to complete the present invention, and are provided to completely inform the scope of the invention to those of ordinary skill in the art to which the present invention belongs. Accordingly, the present invention is only defined by the scope of the claims.

In addition, in describing the present invention, when it is determined that related known technologies or the like may obscure the subject matter of the present invention, a detailed description thereof will be omitted.

Figure 1:
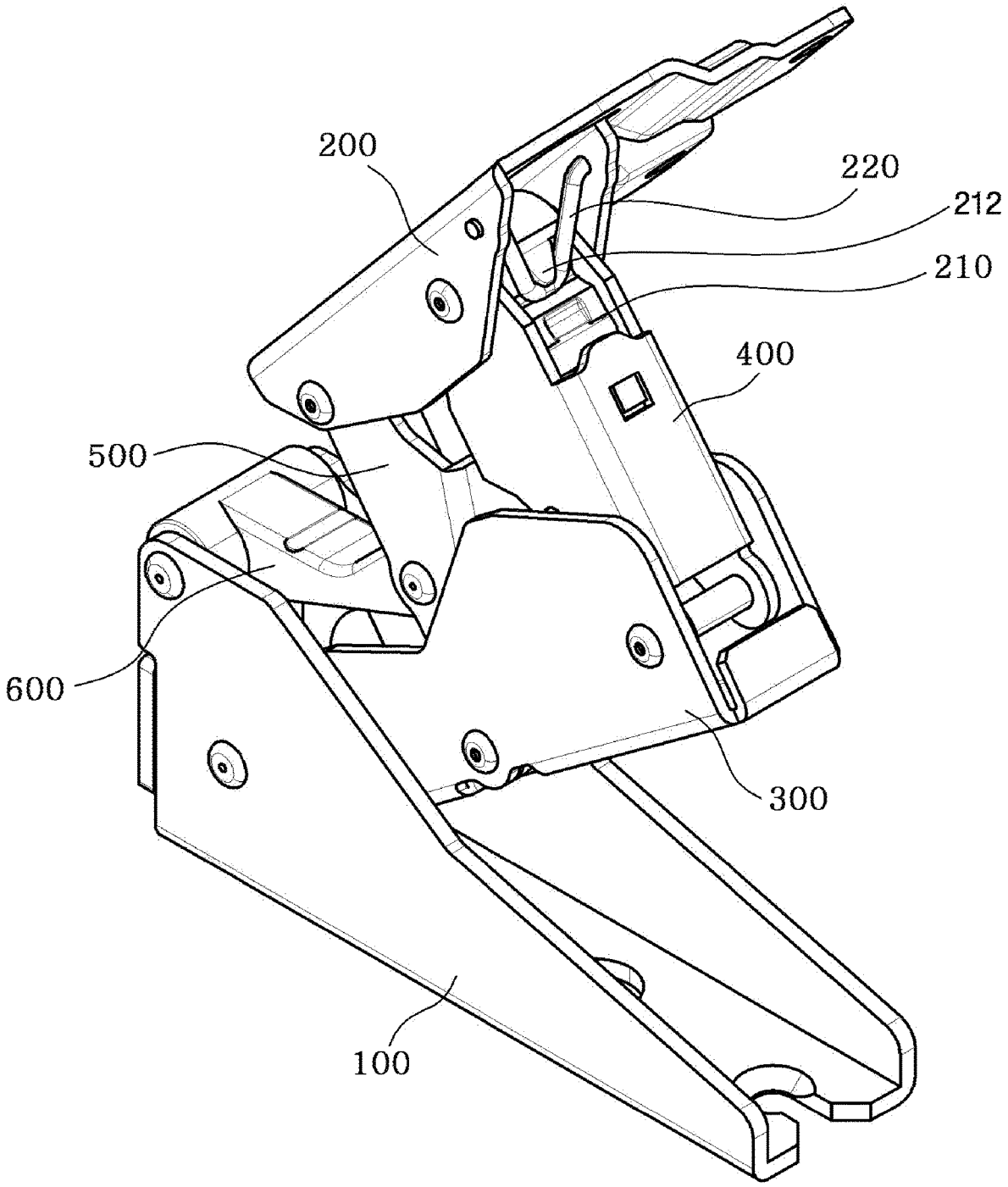
FIG. 1 is a schematic diagram of a multi-link hinge device according to an embodiment of the present invention.
Figure 2:
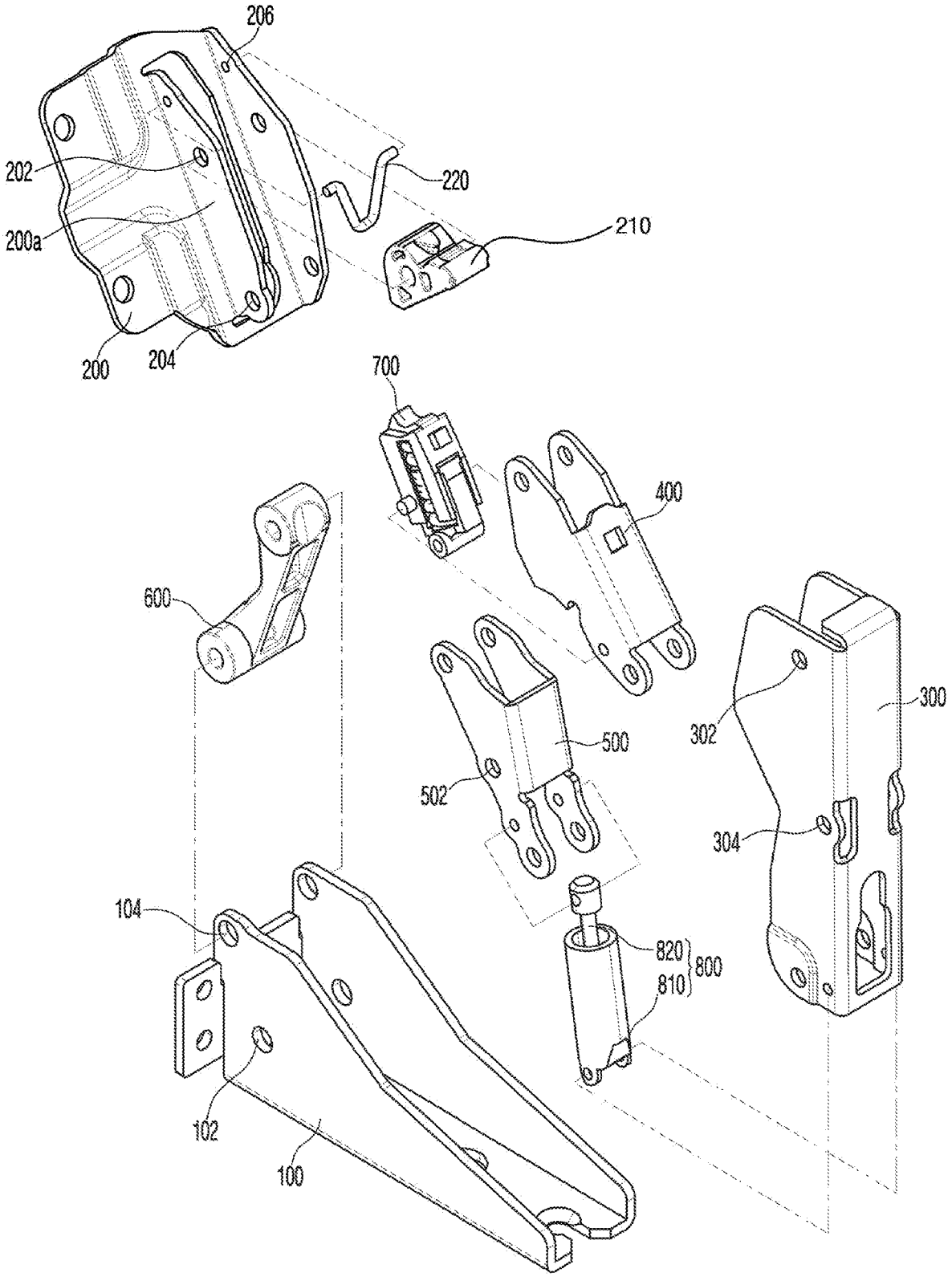
FIG. 2 is a view showing a configuration for the multi-link hinge device according to the embodiment of the present invention.

FIG. 1 is a schematic diagram of a multi-link hinge device according to an embodiment of the present invention, and FIG. 2 is a view showing a configuration for the multi-link hinge device according to the embodiment of the present invention.

Figure 3:
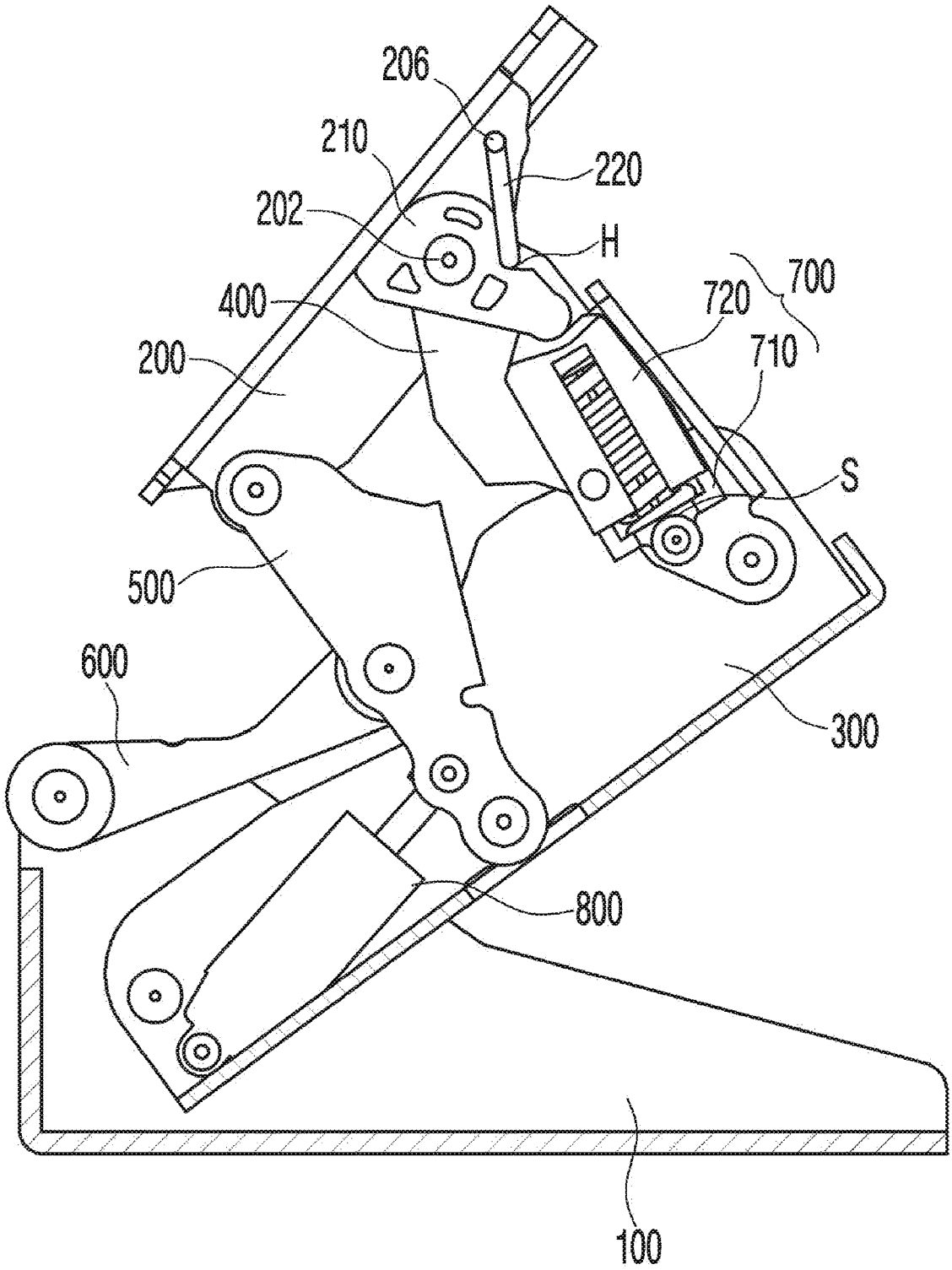
FIG. 3 is a view showing a latching state of a rocker arm and a latching member for the multi-link hinge device according to the embodiment of the present invention.
Figure 4:
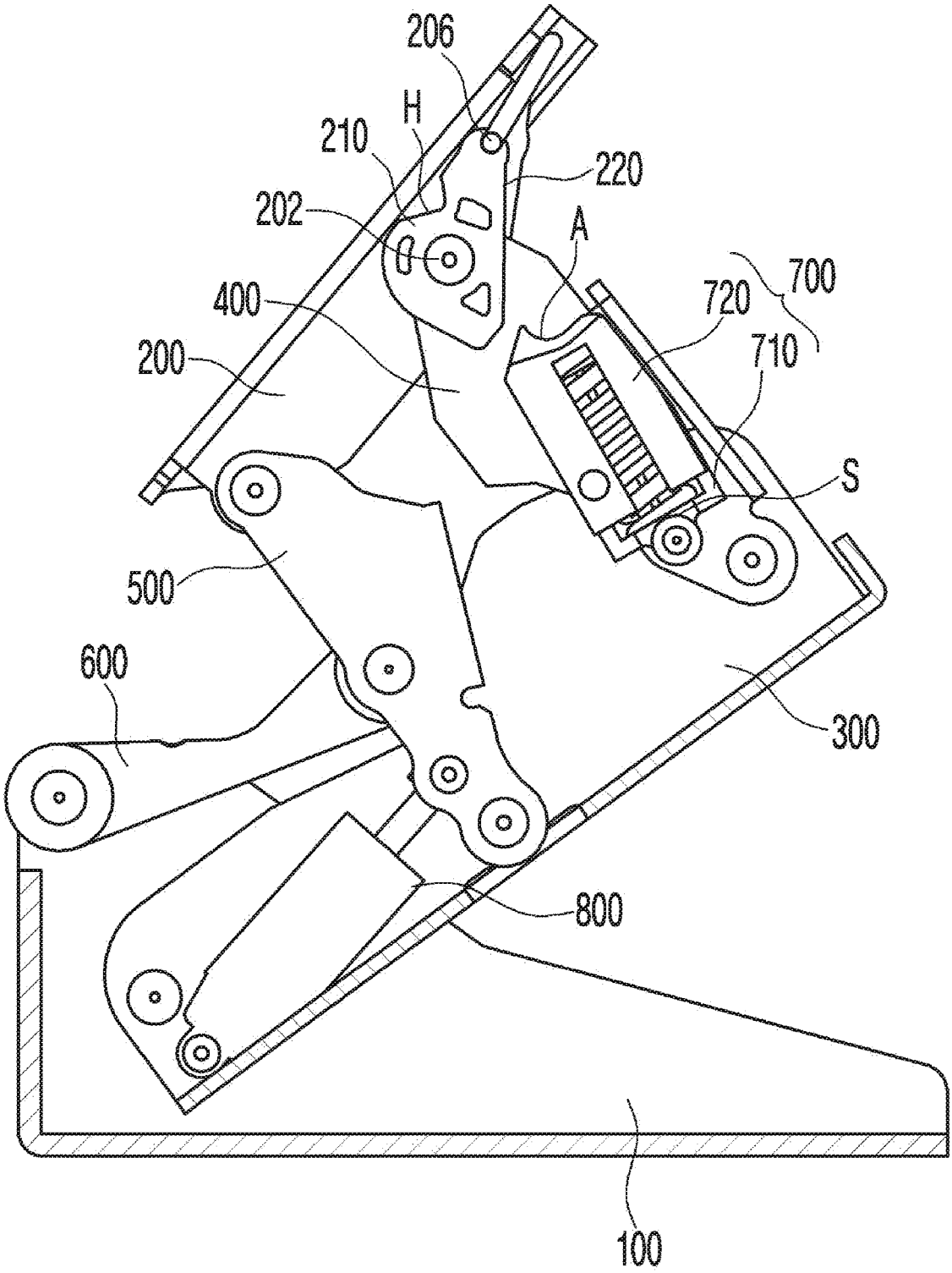
FIG. 4 is a view showing an unlocked state of the rocker arm and the latching member for the multi-link hinge device according to the embodiment of the present invention.

In addition, FIG. 3 is a view showing a latching state of a rocker arm and a latching member for the multi-link hinge device according to the embodiment of the present invention, and FIG. 4 is a view showing an unlocked state of the rocker arm and the latching member for the multi-link hinge device according to the embodiment of the present invention.

As shown in FIGS. 1 and 2, the multi-link hinge device according to the present embodiment includes a bottom lever 100, a top lever 200, a body lever 300, a first link 400, and a second link 500 and a third link 600.

Here, the structure connected by a plurality of levers and links 100, 200, 300, 400, 500 and 600 is a kind of members such as home appliances or furniture with a door. That is, among a plurality of members arranged in a built-in form, a refrigerator may be an example. The plurality of levers and links 100, 200, 300, 400, 500 and 600 are rotatably connected to each other, such that the door of the refrigerator can be easily rotated from the open position to the closing position, or from the closing position to the open position even in a narrow space, which will be described as follows.

First, the bottom lever 100 is installed on a main body of a member having a door, and has a first bottom fastening hole 102 and a second bottom fastening hole 104 formed to be spaced apart from the end side thereof.

The top lever 200 is installed on the door that opens and closes the front of the main body as described above, and has a first top fastening hole 202 and a second top fastening hole 204 spaced apart.

The body lever 300 has one end pivotally connected to the first bottom fastening hole 102, and has a first body fastening hole formed at the other end and a second body fastening hole 204 formed inside.

In addition, the first link 400 is pivotally connected to the first top fastening hole 202 and the first body fastening hole 302.

In addition, the second link 500 is pivotally connected to the second top fastening hole 204 and the second body fastening hole 304, and has a link central fastening hole 502 formed inside.

Further, the third link 600 is pivotally connected to the link central fastening hole 502 and the second bottom fastening hole 104.

Meanwhile, in the case of the multi-link hinge device according to the present embodiment, a rocker arm 700 is further included, and the rocker arm 700 is pivotally connected to the first link 400 and guides the door to selectively move to the closing position by elasticity when the top lever 200 for opening and closing the door is operated.

This rocker arm 700 includes a body 710 and an elevating member 720.

First, the main body 710 is coupled to the first link 400 and has a receiving area therein.

The main body 710 is formed in a box shape having a predetermined size, and an elastic member S is provided inside the receiving area.

The elevating member 720 is provided to cover one end of the main body 710, and is coupled to be able to move up and down in the upper portion of the main body 710 by an elastic member S. In addition, it may be provided such that an elastic action section A is formed at a position facing the latching member 210 provided in the top lever 200.

That is, the elastic action section A is provided such that one end of the latching member 210 formed in a semicircular groove shape is seated. Accordingly, in a state in which the latching member 210 is axially rotated in the first top fastening hole 202 and one end thereof is latched and positioned inwardly (a state in which the elastic member S is compressed by the elevation of the elevating member 720), the elastic action section A allows the elastic restoring force to be selectively applied toward the door moving to the closing position and thus cit guides the door to move quickly to the closing position by the elastic restoring force.

Herein, the top lever 200 may further include a locking member 220, and the locking member 220 is provided in a 'E' or 'C' shape so that both ends are rotatably coupled to the lower portion of the top lever 200, more specifically, to a third top fastening hole 206 of a coupling member 200*a*.

This locking member 220 is formed to be selectively inserted into a latching groove H provided on one side of the latching member 210 during the rotational movement. As shown in FIG. 3, if the locking member is inserted into the latching groove H, the door may be continuously and elastically moved by supporting the latching member 210. On the contrary, as shown in FIG. 4, in a state in which the locking member 220 is latch-released from latching in the latching groove H, even if the latching member 210 is positioned inside the elastic action section A during the movement of the door, the state cannot be fixed by the locking member 220. Thus, the elastic restoring force will not be transmitted to the top lever 200, so that a free movement of the door may be possible.

Therefore, in the multi-link hinge device according to the present embodiment, a state in which the latching member 210 may be latched on or latch-released from the elastic action section A may be maintained by using the locking member 220 when the door is moved along the closing position. Accordingly, the door may be moved selectively and elastically, thereby preventing the door from elastically moving differently from the user's intention. As a result, it is possible to prevent in advance the user's injury due to the door moving rapidly to the closing position contrary to the user's intention.

In addition, in the multi-link hinge device according to the present embodiment, it is possible for a user to selectively latch the locking member 220 into the latching groove H such that a position of the latching member 210 positioned in the elastic action section A is supported. Thereby, the position of the latching member 210 can be reliably fixed by only a simple operation that the locking member 220 is moved in rotation and latch-positioned into the latching hole H. As a result, the door can be easily moved selectively and elastically.

Figure 5:
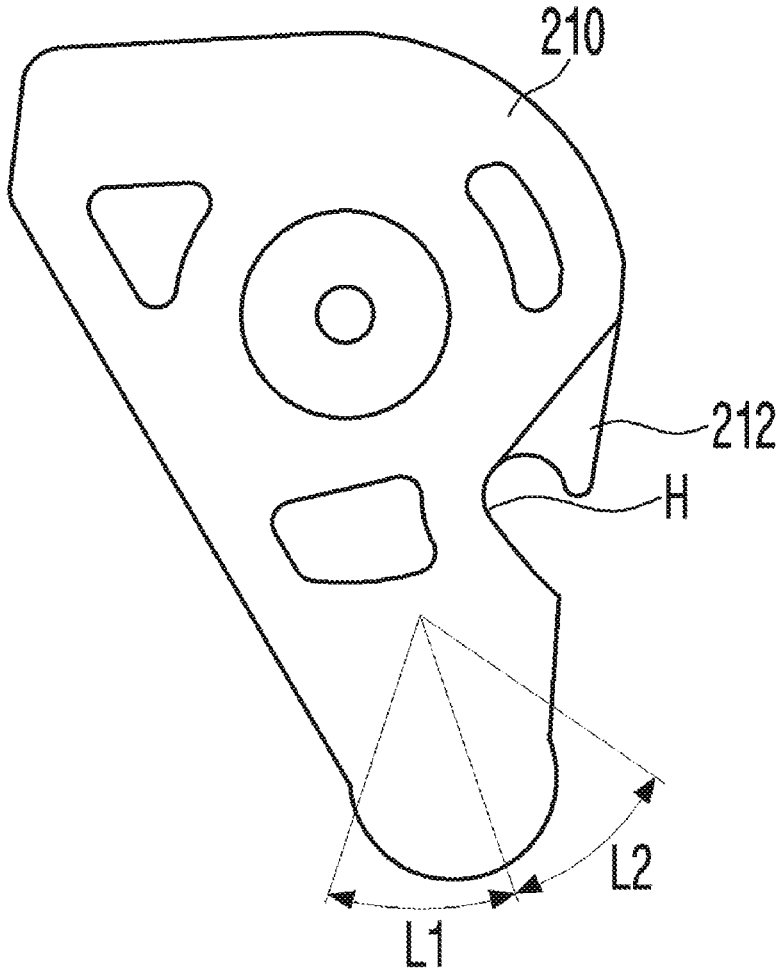
FIG. 5 is a view showing a constant speed section and an acceleration section of the latching member for the multi-link hinge device according to the embodiment of the present invention.
Figure 6:
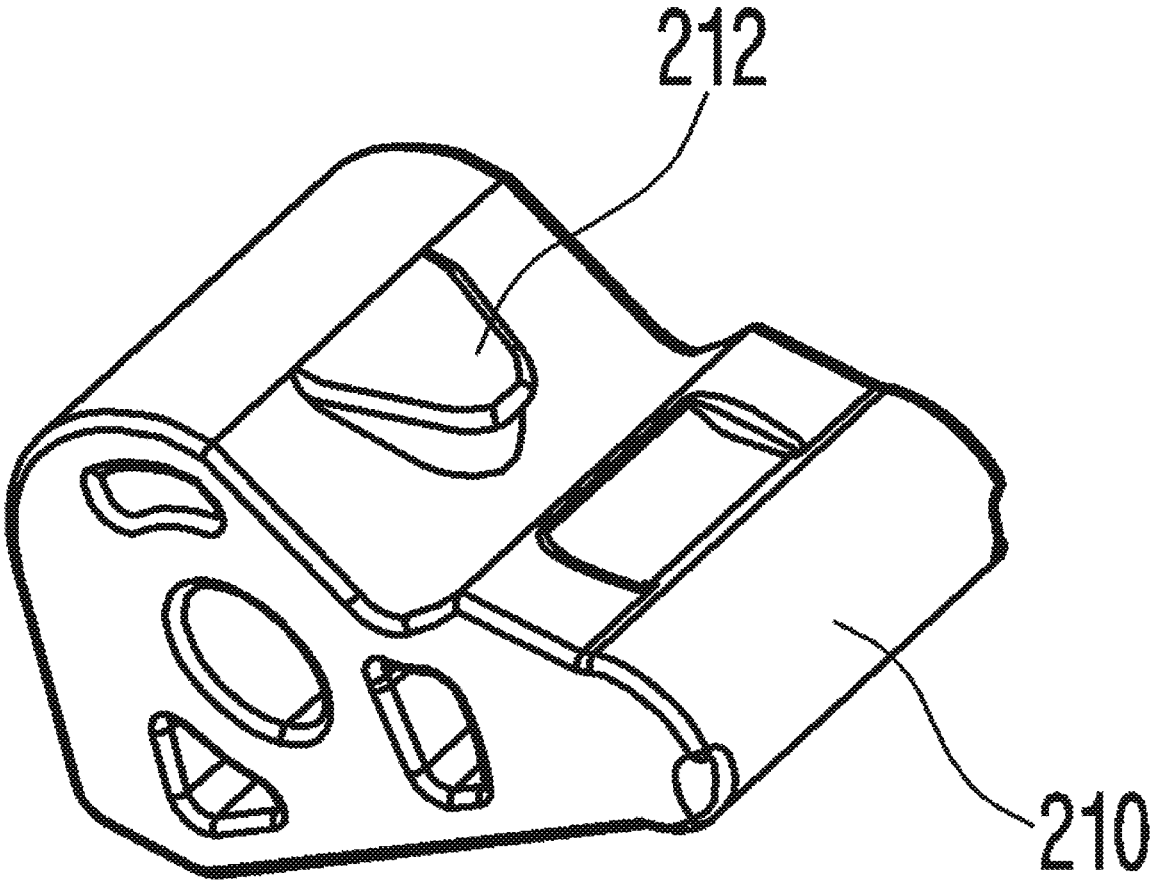
FIG. 6 is a view showing a structure of the latching member for the multi-link hinge device according to the embodiment of the present invention.
Figure 7:
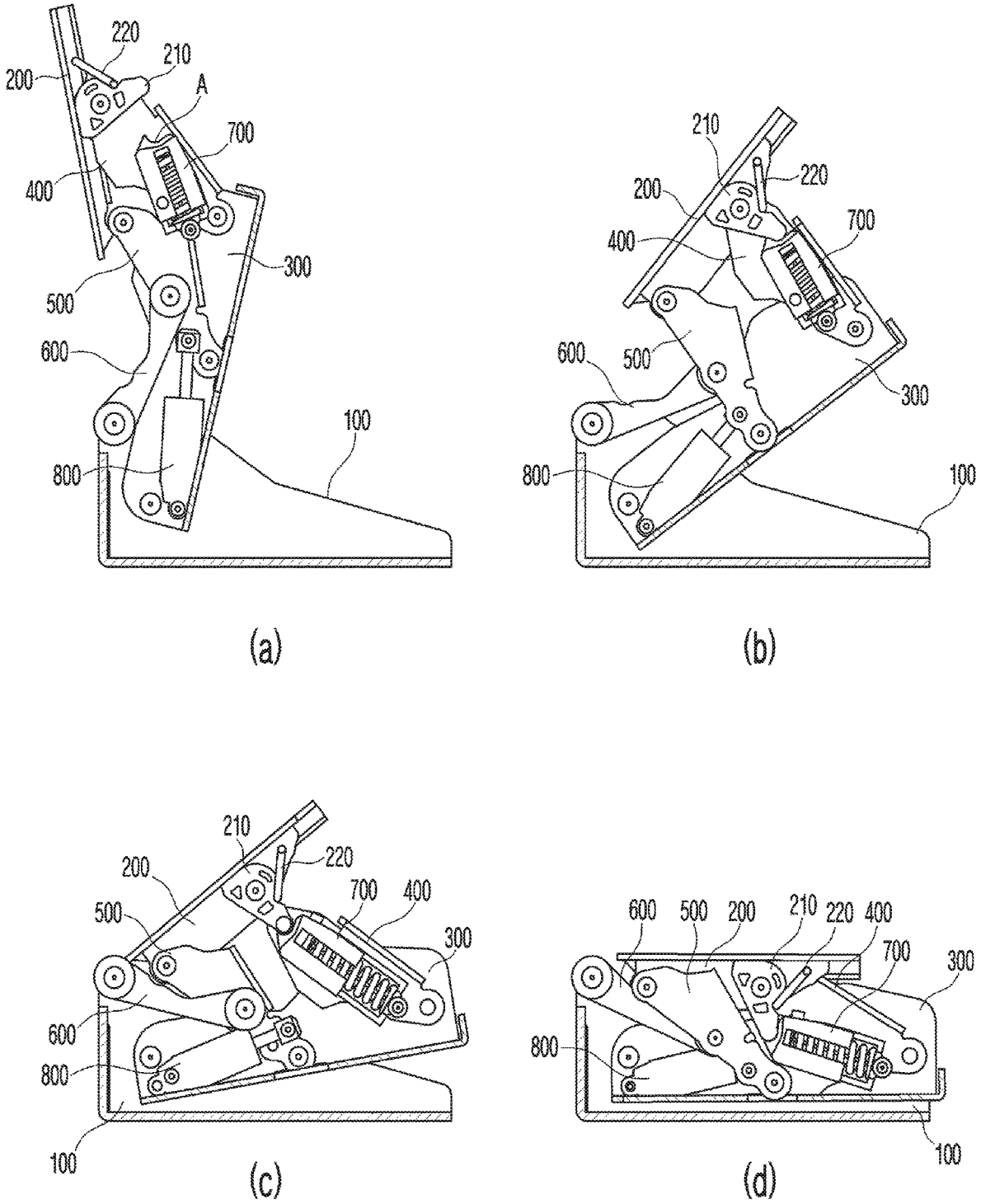
FIG. 7 is a view sequentially showing an operation according to a movement of a door to a closing position for the multi-link hinge device according to the embodiment of the present invention.

Hereinafter, FIG. 5 is a view showing a constant speed section and an acceleration section of the latching member for the multi-link hinge device according to the embodiment of the present invention, FIG. 6 is a view showing a structure of the latching member for the multi-link hinge device according to the embodiment of the present invention, and FIG. 7 is a view sequentially showing an operation according to a movement of a door to a closing position for the multi-link hinge device according to the embodiment of the present invention;

As shown in FIG. 5, the latching member 210 may be formed in a radial shape and consists of a constant velocity section L1 formed in a round shape and an acceleration section L2 formed with a sharp slope in the constant velocity section L1, and accordingly, the latching member 210 may allow the top lever 200 for opening and closing the door to sequentially move toward the closing position at constant speed and acceleration when the top lever 200 is operated.

Herein, it is assumed that the locking member 220 is latched into the latching groove H (refer to FIG. 3), in a state in which the locking member 220 is latch-positioned on the elastic action section A, using the structural features of the latching member 210 as described above. The closing operation of the multi-link hinge device along the constant velocity section L1 and the acceleration section L2 will then be described with reference to FIG. 7 as follows.

First, in a case where the door starts to move from the open position to the closing position (FIG. 7A), the latching member 210 elastically moves at a relatively slow speed by the constant velocity section L1 in the elastic action section A (FIG. 7B). And then, if the latching member 210 reaches a predetermined position in which the closing operation is performed, it moves elastically at a high speed in the acceleration section L2 as the angle of the latching member 210 in the elastic action section A is changed (FIG. 7C). Consequently, the door can be easily moved to the closing position by the elastic restoring force without applying a large force by the user (FIG. 7D).

In this case, when starting to move at a high speed through the acceleration section L2 (FIG. 7C), the damping force is applied to the body lever 300 by the damper unit 800. Accordingly, it is possible to reduce the speed of the elastic movement of the door that rapidly moves to the closing position through the acceleration section L2.

Conversely, if the latching member 210 is latch-positioned on the elastic action section A (the locking member 220 is not in operation), the elastic restoring force of the rocker arm 700 is not transmitted (connected) to the top lever 200. Thus, it is possible to be freely moved when opening and closing the door. Thereby, for example, when working for a long time on the main body of a member with a door, it is possible to prevent the user from unintentionally moving to the closing position due to the elastic restoring force, and as a result, it is possible to prevent injury to the user.

Meanwhile, the damper unit 800 formed to reduce the elastic moving speed of the door includes a cylinder tube 810 and a piston rod 820.

First, the cylinder tube 810 is rotatably connected to the bottom lever 100, and includes fluid stored therein. In addition, a piston (not shown) applying a damping force toward the body lever 300 is accommodated so as to be slidable by the fluid.

In addition, the piston rod 820 has a length and is connected to the piston (not shown), extends to the outside of the cylinder tube 810, and is rotatably connected to the body lever 30. In addition, it allows a piston (not shown) to pass through a fluid inside the cylinder tube 810 to allow an elevating and sliding movement, thereby effectively reducing the speed of a door that rapidly elastically moves.

Meanwhile, as shown in FIG. 6, the latching member 210 according to this embodiment includes a latching piece 212 formed to protrude inside the latching groove H so that a position of the locking member 220 is fixed inside the latching groove H.

The latching piece 212 is preferably formed in a shape corresponding to the shape of the inner circumferential surface of the locking member 220. In addition, it is preferable that the latching piece 212 has a predetermined inclination and depth formed to be bent to prevent the separation of the locking member 220 when it is in the latching position.

Accordingly, when the locking member 220 is latched on the latching piece 212, the latching member 210 can be reliably fixed through the shape and characteristics of the latching piece 212 as described above. Therefore, when the door moves rapidly to the closing position along the acceleration section L2, it can be prevented from being separated from the latching piece 212 in advance, and as a result, result, it is possible to guide the latching state of the latching member 210 to be stably maintained.

Figure 8:
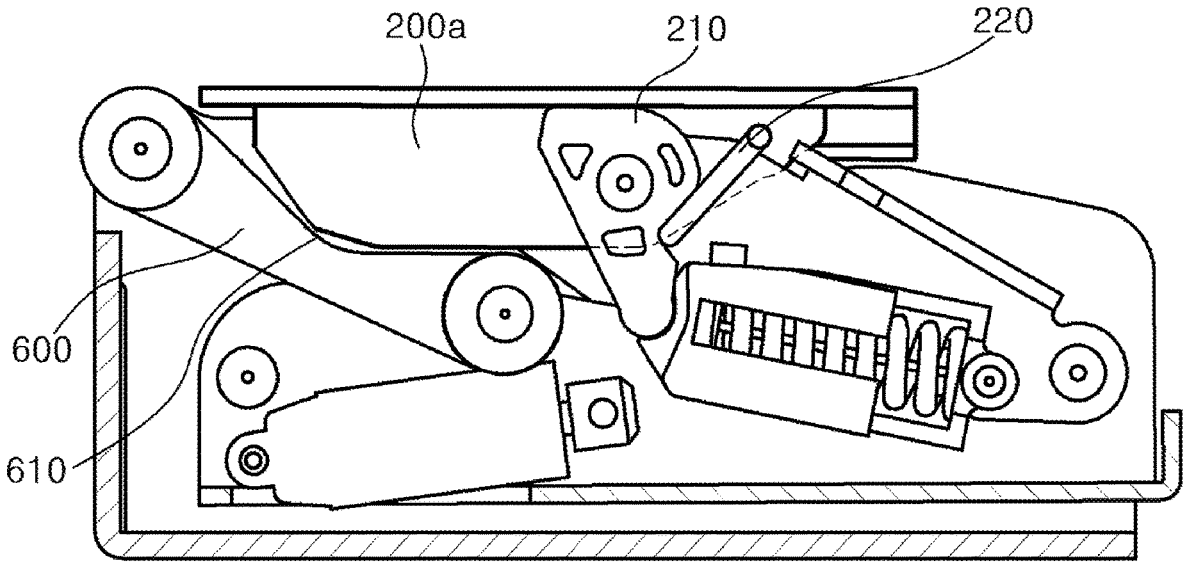
FIG. 8 is a view showing a structure of a third link for the multi-link hinge device according to the embodiment of the present invention.

Hereinafter, FIG. 8 is a view showing a structure of a third link for a multi-link hinge device according to an embodiment of the present invention.

As shown in FIG. 8, the multi-link hinge device according to the present embodiment includes the third link 600. This third link 600 includes a concave portion 610 formed to have a shape corresponding to the lower shape of the coupling member 200*a* formed on the top lever 200 to guide the coupling of the locking member 220 and the second link 500 when the door is moved to the closing position.

That is, the concave portion 610 is formed on one surface of the third link 600 facing the coupling member 200*a* in a state in which the door is moved to the closing position. In this case, when the door is moved to the closing position, the coupling member 200*a* and the third link 600 are arranged to overlap each other to cause interference therebetween. To avoid it, the concave portion (610) may be configured to be formed on one side of the third link (600) to correspond to the lower shape of the coupling member 200*a*. As a result, the interference between the coupling member 200*a* and the third link 600 may be prevented in advance, and accordingly, it is possible to prevent wear and damage due to collision between members during the repeated movements of the door.

In addition, the weight of the third link 600 can be reduced through the concave portion 610 formed in the shape as described above. At the same time, since the third link 600 can perform the same role while having a smaller area than the conventional third link area, the cost of manufacturing the multi-link hinge device can be reduced and the weight can be reduced as well.

According to the present invention, the multi-link hinge device may be provided with a rocker arm on which an elastic action section is provided, and the latching member is latched on or latch-released from the locker arm when the door is moved along the closing position, such that the door can be selectively and elastically moved. Thereby, it is possible to block the elastic movement of the door contrary to the user's intention, and thereby has the effect of preventing the user's injury in advance.

In addition, according to the present invention, the multi-link hinge device may be provided with a concave portion formed concave with a predetermined slope on the third link disposed to overlap with the top lever when the door is moved to the closing position. Thereby, the interference between the top lever and the third link can be prevented in advance, and accordingly, it has the effect of preventing wear and damage caused by collisions between members during the repeated movements of the door.

The present invention has been described above with reference to the embodiment(s) shown in the drawings, but this is only exemplary, and various modifications may be made therefrom by those of ordinary skill in the art. In addition, it will be appreciated that all or some of the above-described embodiment(s) may be selectively combined and configured. Therefore, the true technical scope of the present invention should be determined by the technical spirit of the appended claims.

What is claimed is:

1. A multi-link hinge device, comprising:

a bottom lever installed on a main body of a member with a door and having a first bottom fastening hole and a second bottom fastening hole formed to be spaced apart from an end side;

a top lever installed on the door of the main body and having a first top fastening hole and a second top fastening hole spaced apart from each other;

a body lever having one end pivotally connected to the first bottom fastening hole and having a first body fastening hole formed at the other end and a second body fastening hole formed inside;

a first link pivotally connected to the first top fastening hole and the first body fastening hole;

a second link pivotally connected to the second top fastening hole and the second body fastening hole, and having a link central fastening hole formed inside;

a third link pivotally connected to the link central fastening hole and the second bottom fastening hole; and a rocker arm that is pivotally connected to the first link and guides the door to move to a closing position selectively by elasticity when the top lever for opening and closing the door is operated, wherein the top lever includes a latching member that is rotatably provided so as to be selectively latch-positioned on an elastic action section formed on the rocker arm, and receives an elastic force from an elastic member provided on the rocker arm to guide the door to elastically move along the elastic action section, wherein the top lever further includes a locking member in which the door is continuously elastically moved by supporting the latching member when it is latched into a latching groove provided in the latching member, and the elastic movement of the door is released when it is latch-released into the latching groove, and wherein the latching member includes a latching piece formed to protrude inside the latching groove so that a position of the locking member is fixed inside the latching groove.

2. The multi-link hinge device as claimed in claim 1, wherein the latching member has a constant velocity section and an acceleration section so as to sequentially move toward the closing position at constant velocity and acceleration when the top lever is operated.

3. The multi-link hinge device as claimed in claim 1, wherein the rocker arm includes:

a main body coupled to the first link and having a receiving area therein; and an elevating member coupled to the upper portion of the main body by an elastic member provided in the receiving area to be able to move up and down and to form the elastic action section.

4. The multi-link hinge device as claimed in claim 1, further comprising a damper unit hingedly coupled to the bottom lever and the body lever and configured to apply a damping force to the body lever when the top lever is operated.

5. The multi-link hinge device as claimed in claim 4, wherein the damper unit includes:

a cylinder tube rotatably connected to the bottom lever and accommodated so that a piston applying the damping force toward the body lever is slidable by a fluid; and a piston rod having a length and connected to the piston and extending to the outside of the cylinder tube and rotatably connected to the body lever.

6. The multi-link hinge device as claimed in claim 1, wherein the third link includes a concave portion formed to have a shape corresponding to a lower shape of a coupling member of the top lever that guides coupling of the second link when the door is moved to the closing position.

* * * * *